US005448032A

United States Patent [19]

Wagatuma

[11] Patent Number: 5,448,032

[45] Date of Patent: Sep. 5, 1995

[54] CONTACT UNIT FOR A SWITCH

[75] Inventor: Toru Wagatuma, Furukawa, Japan

[73] Assignee: Alps Electric Co., Ltd., Tokyo, Japan

[21] Appl. No.: 276,881

[22] Filed: Jul. 18, 1994

Related U.S. Application Data

[63] Continuation of Ser. No. 15,734, Feb. 10, 1993, abandoned.

[30] Foreign Application Priority Data

Feb. 24, 1992 [JP] Japan ..... 4-036599

[51] Int. Cl.[6] ..... H01H 1/14

[52] U.S. Cl. ..... 200/534; 200/535; 200/275

[58] Field of Search ..... 200/534, 535, 536, 303, 200/520, 553, 554, 275, 244, 245, 246, 254, 255, 257

[56] References Cited

U.S. PATENT DOCUMENTS

| | | | |
|---|---|---|---|
| 3,916,131 | 10/1975 | Golbeck et al. | 200/535 |
| 3,920,943 | 11/1975 | Lapointe | 200/535 |
| 4,027,129 | 5/1977 | Sato | 200/535 |
| 4,684,775 | 8/1987 | Oba . | |
| 4,698,465 | 10/1987 | Oba | 200/536 |
| 4,789,764 | 12/1988 | Doros | 200/535 |
| 4,937,407 | 6/1990 | Osika | 200/303 |

*Primary Examiner*—Henry J. Recla
*Assistant Examiner*—David J. Walczak
*Attorney, Agent, or Firm*—Guy W. Shoup; Patrick T. Bever

[57] ABSTRACT

A contact unit for a switch comprises: a wafer comprising a first terminal, a second terminal separated from the first terminal, and a fixed contact having the shape of a spring metal clip and electrically connected to the first terminal; an elastic movable contact electrically connected to the second terminal and capable of being brought into contact with the fixed contact; and an actuator for applying pressure to the elastic movable contact to bring the elastic movable contact into contact with the fixed contact. The second terminal is a portion of a spring metal frame, and the elastic movable contact is formed by bending a portion of the same spring metal frame. The first terminal, the second terminal, the fixed contact and the elastic movable contact are combined by insert molding to form the integral contact unit. Thus, the elastic movable contact is never disconnected from the second terminal, the contact unit is highly reliable and the contact unit can be readily applied to various kinds of switches.

8 Claims, 5 Drawing Sheets

CONTACT UNIT FOR A SWITCH

This application is a continuation of application Ser. No. 08/015,734, filed Feb. 10, 1993 now abandoned.

BACKGROUND OF THE INVENTION

1. Field of the Invention

The present invention relates to a contact unit for a switch, incorporating an elastic movable contact.

2. Description of the Prior Art

A switch employing a contact unit of this kind is closed when a force is applied through an actuator to an elastic movable contact to bring the elastic movable contact into contact with a fixed contact. The elastic movable contact is separated automatically by its elasticity from the fixed contact to open the switch when the force applied to the actuator is removed. Therefore the actuator can be returned to its initial position by the spring force of the elastic movable contact without using any special members for returning the actuator to its initial position. Thus, the switch has a simple construction and comprises a relatively small number of parts. A contact unit for a switch disclosed in Japanese Utility Model Laid-open (Kokai) No. 61-112536 employs a torsion coil spring as such an elastic movable contact, which is brought into contact with a fixed contact having the shape of a spring metal clip.

FIG. 6 is an exploded perspective view of a switch employing a prior art contact unit. This contact unit comprises a wafer 1 formed by molding and comprising a contact housing and a metal plate 2 combined with the contact housing by insert molding, a torsion coil spring 5 serving as both a movable contact and a return spring, an actuator 6 through which a pressure is applied to the torsion coil spring 5, and a cover 7 supporting the actuator 6 for axial movement and joined to the wafer 1. Terminals 3*a* and 3*b* projecting outside from the wafer 1, and a fixed contact 4 having the shape of a spring metal clip and standing upright within the wafer 1 are formed beforehand by pressing the metal plate 2. Although the terminal 3*a* connected to the fixed contact 4, and the terminal 3*b* with which the torsion coil spring 5 is brought into contact are connected outside the wafer as shown in FIG. 6, a portion of the metal plate 2 interconnecting the terminals 3*a* and 3*b* is cut off before completing the contact unit to disconnect the terminals 3*a* and 3*b* from each other.

One end of the spring wire forming the torsion coil spring 5 is extended substantially perpendicularly to the axis of the coiled portion 5*a* of the torsion coil spring 5 to form an elastic arm 5*b*, the free end of the elastic arm 5*b* is bent in a direction parallel to the axis of the coiled portion 5*a* to form an engaging portion 5*c* that engages the actuator 6, and the free end of the engaging portion 5*c* is bent toward the coiled portion 5*a* to form a contact portion 5*d*. When assembling the torsion coil spring 5, the wafer 1 and the actuator 6, the coiled portion 5*a* is put on the contact housing of the wafer 1 with the contact portion 5*d* located obliquely above the fixed contact 4 and the coiled portion 5*a* in contact with the metal plate 2 so that the torsion coil spring 5 is connected electrically to the terminal 3*b*, and the actuator 6 is put on the wafer 1 with its actuating part 6*a* seated on the engaging portion 5*c* of the torsion coil spring 5. The cover 7 has a guide hole 7*a* for guiding the actuator 6, and a holding portion 7*b* for holding the coiled portion 5*a* of the torsion coil spring in place on the wafer 1.

In this prior art contact unit, when no pressure is applied to the actuator 6, the actuator 6 is held at an upper position by the spring force of the torsion coil spring 5, and the contact portion 5*d* is separated from the fixed contact 4 as shown in FIG. 7(*a*), so that the terminals 3*a* and 3*b* are disconnected to open the switch.

When pressure is applied to the actuator 6, the actuating part 6*a* depresses the engaging portion 5*c* to bend the elastic arm 5*b* elastically so that the contact portion 5*d* is moved obliquely downward. When the actuator 6 is depressed by a predetermined distance, the contact portion 5*d* is forced to enter between the contact tongues 4*a* of the fixed contact 4 to connect the terminals 3*a* and 3*b* through the fixed contact 4 and the torsion coil spring 5, so that the switch is closed.

When the pressure is removed from the actuator 6, the elastic arm 5*b* of the torsion coil spring 5 restores its original shape automatically, the contact portion 5*d* is disengaged from the contact tongues 4*a* of the fixed contact 4 to open the switch and the actuator 6 is raised to its initial position by the engaging portion 5*c* as shown in FIG. 7(*a*).

In this prior art contact unit, even a slight dislocation of the torsion coil spring 5 is liable to cause imperfect contact between the coiled portion 5*a* of the torsion coil spring 5 and the metal plate 2, because the torsion coil spring 5 is connected electrically to the terminal 3*b* by holding the coiled portion 5*a* put on the wafer 1 in contact with the metal plate 2. Thus, the electrical connection of the torsion coil spring 5 serving as a movable contact and the terminal 3*b* is not highly reliable. Furthermore, the assembly of the torsion coil spring 5 and the wafer 1 requires troublesome assembling work particularly when the contact unit is designed for a small switch.

SUMMARY OF THE INVENTION

Accordingly, it is an object of the present invention to provide a contact unit for a switch, having an elastic movable contact capable of being surely held in electrical contact with a terminal, and capable of being readily assembled.

In one aspect of the present invention, a contact unit for a switch comprises: a wafer provided with a first terminal, a second terminal isolated from the first terminal, and a fixed contact having the shape of a spring metal clip; an elastic movable contact electrically connected to the second terminal and capable of engaging the fixed contact; and an actuator for applying pressure to the elastic movable contact; wherein the elastic movable contact is a portion of a spring metal frame integrally combined with the wafer.

The spring plate having a portion serving as the elastic movable contact can be firmly connected to the second terminal or an extended portion of the spring plate can be used as the second terminal. Accordingly, the reliability of the electrical connection of the elastic movable contact and the second terminal is improved greatly. If the wafer and the spring plate are integrated by insert molding, assembling work for assembling the elastic movable contact and the wafer is omitted, which facilitates assembling the contact unit. Since the contact unit comprises, integrally, the wafer integrally provided with the fixed contact and the terminals for the fixed contact and the movable contact, and the elastic movable contact, the contact unit can be handled as a single unit, and the contact unit can be easily and universally applied to various kinds of switches.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENT

Figure 2:
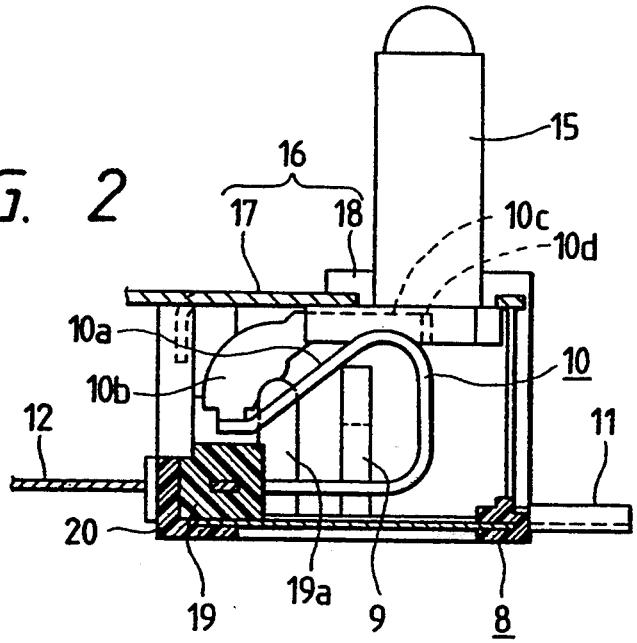
FIG. 2 is a sectional view of the switch of FIG. 1.
Figure 3:
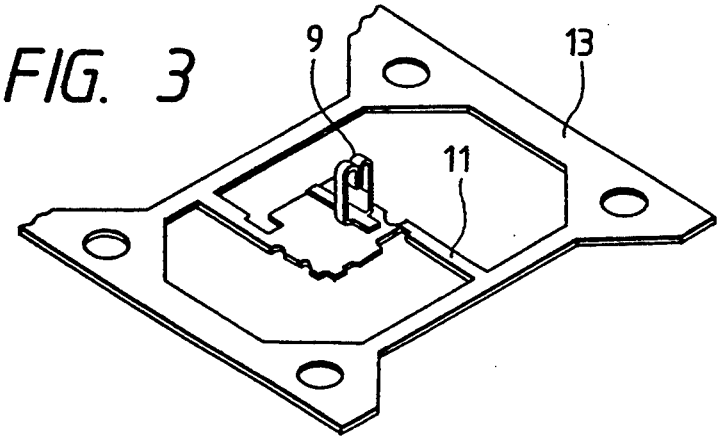
FIG. 3 is a perspective view of a fixed contact included in the contact unit of FIG. 1.
Figure 4A:
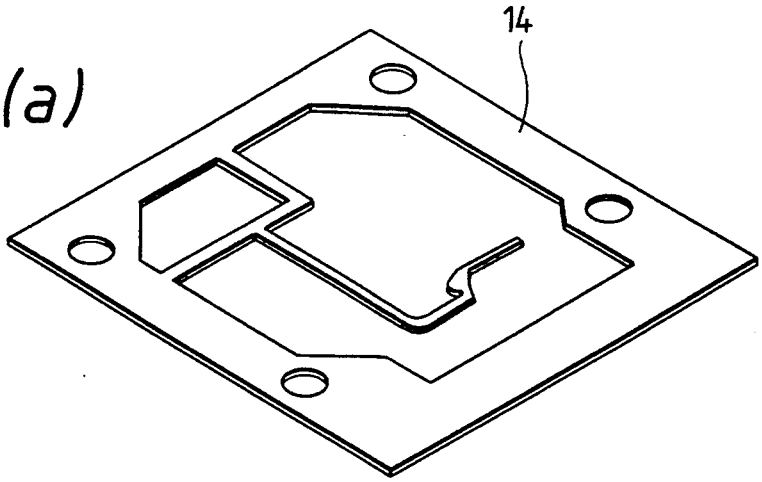
FIGS. 4(*a*), 4(*b*) and 4(*c*) are perspective views of assistance in explaining processes of fabricating an elastic movable contact included in the contact unit of FIG. 1.
Figure 4B:
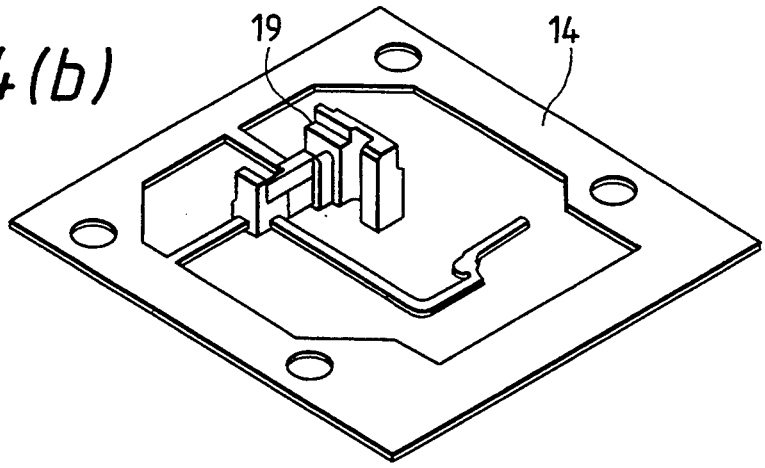
Figure 4C:
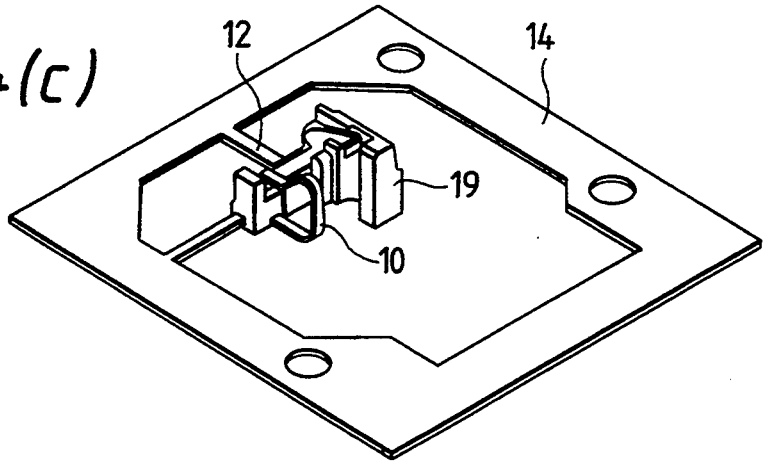
Figure 6:
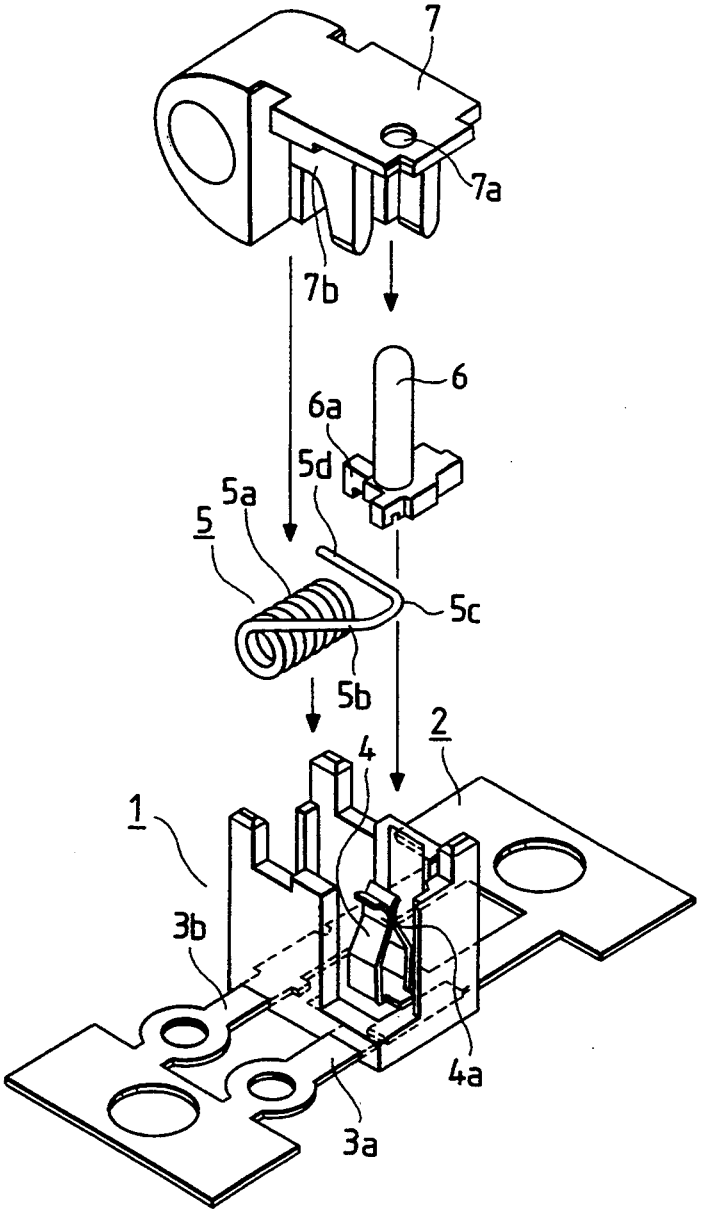
FIG. 6 PRIOR ART
FIG. 6 is an exploded perspective view of a switch employing a prior art contact unit.
Figure 7A:
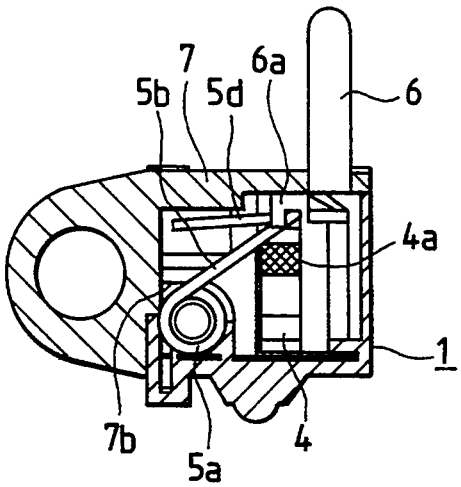
FIG. 7(a) PRIOR ART
FIGS. 7(*a*) and 7(*b*) are sectional views of assistance in explaining the operation of the switch of FIG. 6.
Figure 7B:
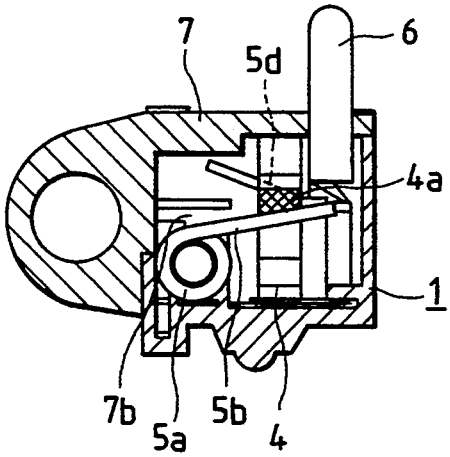
FIG. 7(b) PRIOR ART

Referring to FIGS. 1 to 5, a contact unit embodying the present invention for a switch comprises a fixed contact 9 having the shape of a spring metal clip, an elastic movable contact serving also as a return spring, a first terminal 11 formed integrally with a metal frame 13 (FIG. 3), and a second terminal 12 formed integrally with a spring metal frame 14. The fixed contact 9 is joined to the metal frame 13 by crimping or the like to connect the same electrically to the first terminal 11. The spring metal frame 14 integrally having the elastic movable contact 10 and the second terminal 12 is formed by pressing a metal sheet as shown in FIG. 4(*a*). The fixed contact 9, the metal frame 13 having the first terminal 11, and the spring metal frame 14 having a portion serving as the second terminal 12 are combined by insert molding to form a wafer 8. A cover 16 consists of a guide member 18 formed of a synthetic resin and provided with a guide hole 18*a*, and a mounting member 17 formed of a metal.

In assembling the switch, an actuator 15 is put on the free end of the elastic movable contact 10, and then the cover 16 is combined with the wafer 8 with the actuator 15 slidably received in the guide hole 18*a* of the guide member 18.

Since the contact unit has, in an integral unit, the fixed contact 9 having the shape of a spring metal clip, the elastic movable contact 10 serving as both a movable contact and a return spring, the first terminal 11 fixedly connected to the fixed contact 9, and the second terminal 12 formed integrally with the elastic movable contact 10, the fixed contact 9 and the first terminal 11, and the elastic movable contact 10 and the second terminal 12 are electrically connected securely, and the switch can be readily assembled simply by putting the actuator 15 on the free end of the elastic movable contact 10, and combining the cover 16 formed by combining the guide member 18 and the mounting plate 17 with the contact unit.

Figure 5:
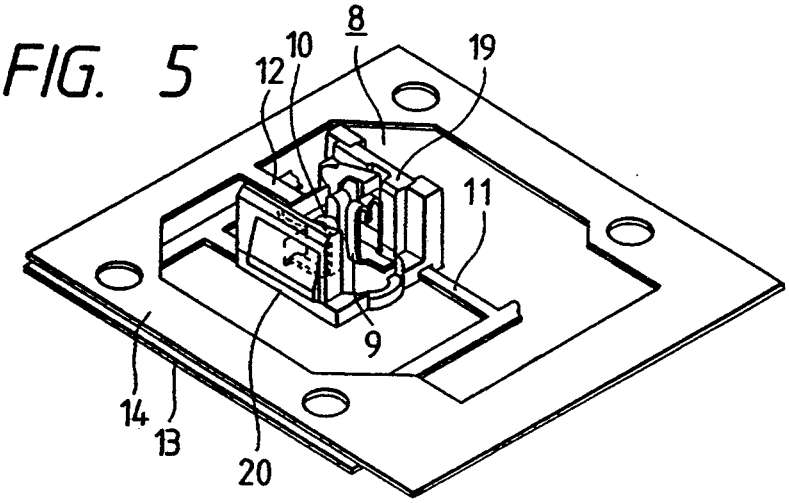
FIG. 5 is a perspective view of an assembly of the elastic movable contact and a wafer.

Processes of fabricating the contact unit will be described hereinafter. As shown in FIG. 3, the metal frame 13 and the first terminal 11 are formed by pressing a metal plate, and then the fixed contact 9 is fixed to the metal frame 13 at a predetermined position on the metal frame 13. The spring metal frame 14 as shown in FIG. 4(*a*) is formed by pressing a metal plate, and the spring metal frame 14 is combined with a first block 19 by insert molding as shown in FIG. 4(*b*), and then a substantially L-shaped portion of the spring metal frame 14 projecting from the first block 19 is bent in a predetermined shape to form the elastic movable contact 10 as shown in FIG. 4(*c*). The metal frame 13, and the spring metal frame 14 provided with the first block 19 are placed in register in a mold, and then a second block 20 having a catch 20*a* as shown in FIG. 5 is molded to form the contact unit integrally having the fixed contact 9, the elastic movable contact 10, the first terminal 11 electrically connected to the fixed contact 9, and the second terminal 12 electrically connected to the elastic movable contact 10. Then, unnecessary portions of the metal frame 13 and the spring metal frame 14 are cut off so that the first terminal 11 and the second terminal 12 are disconnected electrically to complete the contact unit.

The cover 16 can be simply and easily combined with the contact unit by putting the mounting plate 17 on the contact unit so that a latching portion 17*a* of the mounting plate 17 is snapped on the catch 20*a* of the second block 20.

Figure 1:
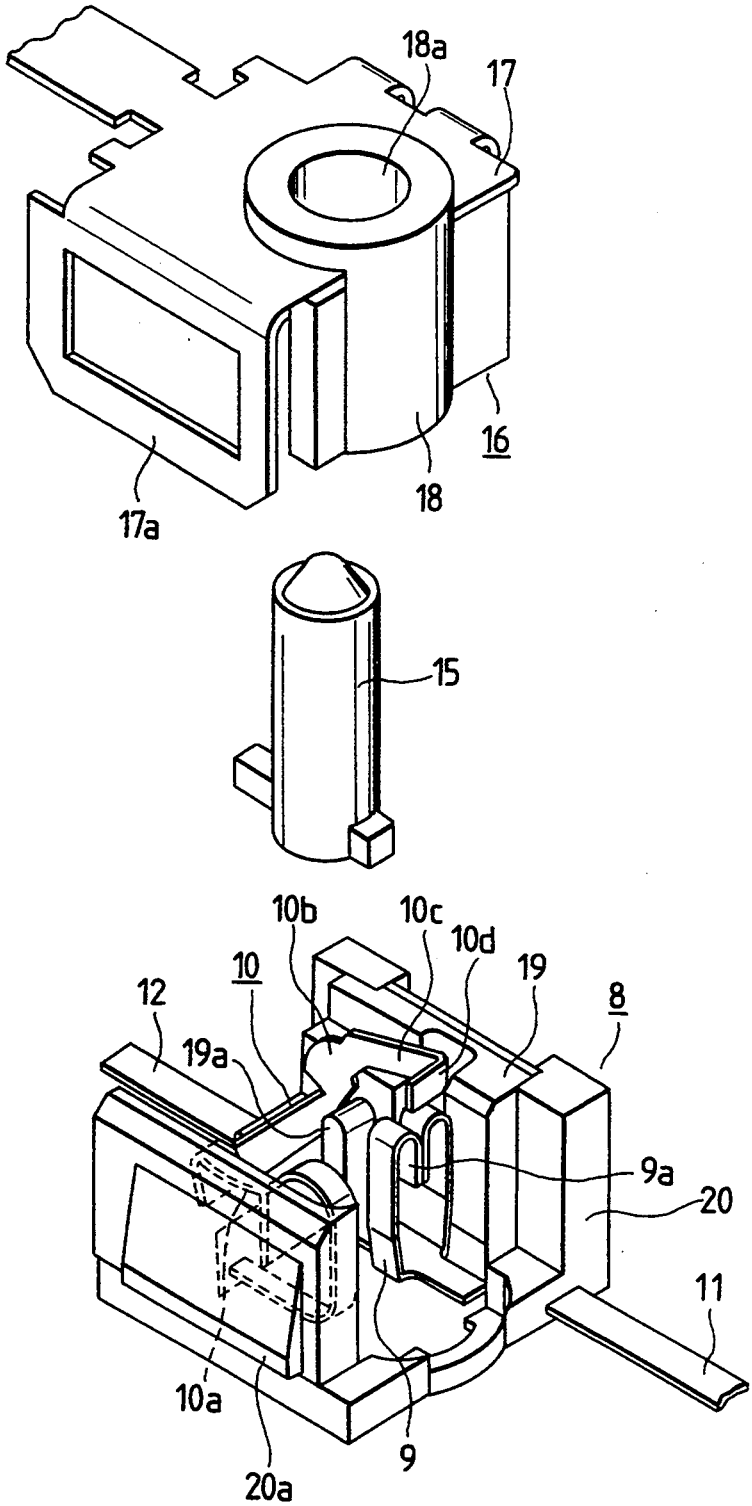
FIG. 1 is an exploded perspective view of a switch employing a contact unit in a preferred embodiment according to the present invention.

As shown in FIGS. 1 and 2, the elastic movable contact 10 has an elastic flexing portion 10*a*, a supporting portion 10*b* resting on a supporting surface 19*a* formed in the first block 19, a contact portion 10*c* to be forced to enter between the contact tongues 9*a* of the fixed contact 9, and an engaging portion 10*d* engaging the actuator 15.

In the normal state, the actuator 15 is held at an upper position, i.e., an initial position, by the resilience of the elastic movable contact 10 and the contact portion 10*c* of the elastic movable contact 10 is separated from the fixed contact 9, and hence the terminals 11 and 12 are disconnected from each other and the switch is open. When the actuator 15 is depressed to push the engaging portion 10*d* by the actuator 15, the elastic flexing portion 10*a* is flexed and the contact portion 10*c* is forced to enter between the contact tongues 9*a* of the fixed contact 9, so that the terminals 11 and 12 are connected electrically through the fixed contact 9 and the elastic movable contact 10 to close the switch.

When the pressure acting on the actuator 15 is removed, the elastic flexing portion 10*a* of the elastic movable contact 10 restores its original shape elastically, so that the contact portion 10*c* is disengaged from the contact tongues 9*a* of the fixed contact 9 and the actuator 15 is raised to its initial position by the engaging portion 10*d*, so that the terminals 11 and 12 are disconnected electrically from each other and the switch is opened.

Although the contact unit in this embodiment employs the spring metal frame 14 integrally having the elastic movable contact 10 and the second terminal 12, and the fixed contact 9 fixed to the first terminal 11 by a fixing means, the elastic movable contact 10 and the second terminal 12 may be formed separately and fixedly connected together by a connecting means, and a metal frame integrally provided with the fixed contact 9 and the first terminal 11 may be employed.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A contact unit for a switch, the contact unit comprising:

a first metal portion including a first base, a fixed contact integrally formed with the first base, and an elongated first terminal integrally formed with the first base;

a second metal portion including a second base, an elongated second terminal integrally formed with the second base, and an elongated movable contact integrally formed with the second base, the movable contact being bent to form a leaf spring; and a molded body integrally molded with the first base of the first metal portion and the second base of the second metal portion to form a one-piece unit;

wherein the fixed contact, the movable contact, the elongated first terminal and the elongated second terminal protrude from the molded body; and wherein an engaging portion of the movable contact is resiliently positioned adjacent the fixed contact.

2. A contact unit according to claim 1 wherein the switch includes a cover connected to the molded body and an actuator movably connected to the cover, the actuator having a first end contacting the movable contact and a second end extending from the cover;

wherein the movable contact resiliently biases the actuator away from the fixed contact.

3. A contact unit according to claim 2 wherein the second metal portion includes a molded portion formed over the base, the molded portion including a support abutting a portion of the movable contact, wherein when the actuator is pressed, the movable contact pivots about the support such that the engaging portion contacts the fixed contact.

4. A contact unit according to claim 1 wherein the fixed contact is a clip-type contact.

5. A push button switch comprising:

a first metal portion including a first base, a fixed contact integrally formed with the first base, and an elongated first terminal integrally formed with the first base;

a second metal portion including a second base, an elongated second terminal integrally formed with the second base, and an elongated movable contact integrally formed with the second base, the movable contact being bent to form a leaf spring; and a molded body integrally molded with the first base of the first metal portion and the second base of the second metal portion to form a one-piece unit;

wherein the fixed contact, the movable contact, the elongated first terminal and the elongated second terminal protrude from the molded body; and wherein an engaging portion of the movable contact is resiliently positioned adjacent the fixed contact.

6. A push button switch according to claim 5 further comprising:

a cover connected to the molded body; and an actuator movably connected to the cover, the actuator having a first end contacting the movable contact and a second end extending from the cover;

wherein the movable contact resiliently biases the actuator away from the fixed contact.

7. A push button switch according to claim 6 wherein the second metal portion further comprises a molded portion formed over the base, the molded portion including a support abutting a portion of the movable contact, wherein when the actuator is pressed, the movable contact pivots about the support such that the engaging portion contacts the fixed contact.

8. A contact unit according to claim 5 wherein the fixed contact is a clip-type contact.

* * * * *